US005417272A

United States Patent [19]

Marlowe et al.

[11] Patent Number: 5,417,272

[45] Date of Patent: May 23, 1995

[54] BATHING DOOR UNIT

[75] Inventors: James L. Marlowe; Ronald M. Wise, both of Union City, Tenn.; Larry D. Bruce, Mayfield, Ky.; James W. Hodges, Palmersville, Tenn.

[73] Assignee: Sterling Plumbing Group, Inc., Rolling Meadows, Ill.

[21] Appl. No.: 87,569

[22] Filed: Jul. 2, 1993

[51] Int. Cl.[6] ..... E05D 15/26

[52] U.S. Cl. ..... 160/202; 160/211; 160/213

[58] Field of Search ..... 160/354, 206, 199, 213, 160/210, 211, 197, 202, 117, 119, 118; 4/557, 607, 610

[56] References Cited

U.S. PATENT DOCUMENTS

| | | | |
|---|---|---|---|
| 2,331,822 | 10/1943 | Zechiel et al. | 160/206 |
| 2,723,896 | 11/1955 | Wurtz | 312/296 |
| 2,850,089 | 9/1958 | Burke | 160/202 |
| 2,852,816 | 9/1958 | Spretnjak et al. | 20/52 |
| 3,054,118 | 9/1962 | Bullock | 4/149 |
| 3,102,581 | 9/1963 | Kochanowski | 4/607 X |
| 3,188,699 | 6/1965 | Walters | 20/19 |
| 3,272,257 | 9/1966 | Dirubbo | 160/354 |
| 3,750,737 | 8/1973 | Woodward | 160/206 |
| 4,276,919 | 7/1981 | Walter | 160/206 |
| 4,437,266 | 3/1984 | Keller | 49/493 |
| 4,619,074 | 10/1986 | Leung et al. | 49/143 |
| 4,635,699 | 1/1987 | Kauffman et al. | 160/211 |
| 4,785,485 | 11/1988 | Etesam | 4/557 |
| 4,878,530 | 11/1989 | Jean | 160/211 |
| 4,897,889 | 2/1990 | Baus | 4/607 |
| 4,914,770 | 4/1990 | Baus | 4/612 |
| 4,981,164 | 1/1991 | Reichel | 160/187 |
| 5,097,543 | 3/1992 | Oille | 4/607 |
| 5,123,129 | 6/1992 | Lyons | 160/213 X |

FOREIGN PATENT DOCUMENTS

| | | |
|---|---|---|
| 0445559 | 9/1991 | European Pat. Off. . |
| 1926341 | 11/1970 | Germany . |
| 3838591 | 5/1990 | Germany . |
| 3838590 | 11/1990 | Germany . |
| 9205399 | 6/1992 | Germany . |
| 4205784 | 10/1992 | Germany . |

*Primary Examiner*—David M. Purol
*Attorney, Agent, or Firm*—Quarles & Brady

[57] ABSTRACT

A pivotal and extendable bathing door unit is disclosed wherein a first panel is pivotally connected to a supporting wall, and a second panel is extendably connected to the first panel, so that the door can operate to enclose without an overhead track. There are roller tracks and rollers cross-linked to each other while permitting lateral relative movement therebetween. In one form, cam members are associated with the pivotal connection of the first panel to provide a lifting action between bistable positions, and a magnetic member is connected to a handle on the second panel for attraction to a similar second panel of a second similar door unit.

12 Claims, 4 Drawing Sheets

FIG. 8
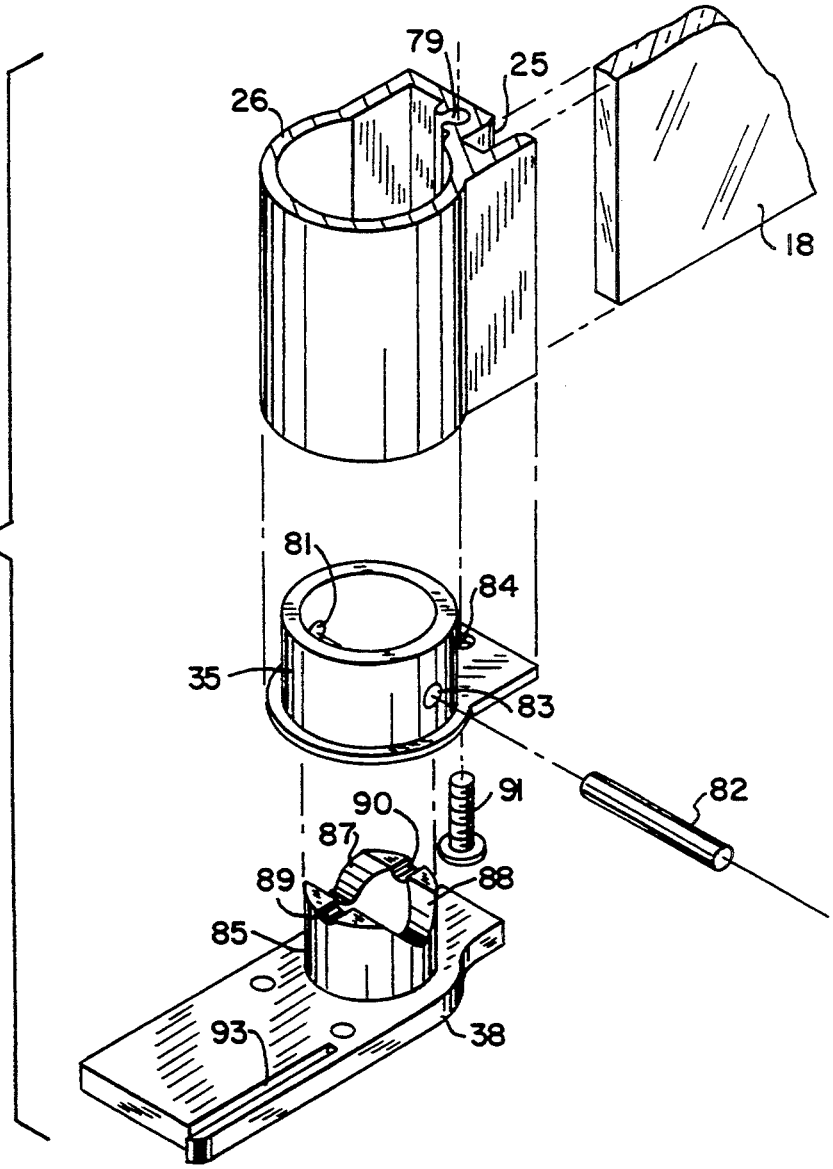
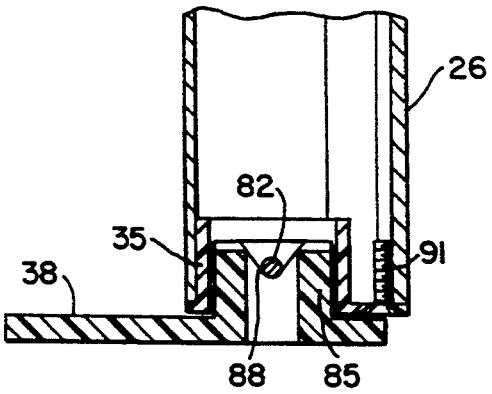
FIG. 9
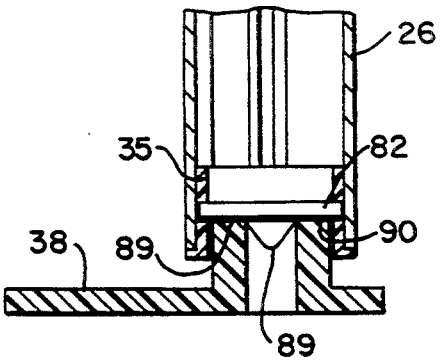
FIG. 10

BATHING DOOR UNIT

BACKGROUND OF THE INVENTION 1. Field of the Invention

This invention relates to doors for bathing fixtures such as showers and bathtubs. More particularly it provides a door of adjustable size that requires no overhead support. 2. Description of the Prior Art In the design of doors for showers and bathtubs, it is desirable to provide as wide open access as possible and still keep the cost of fabrication as low as possible. Such access facilitates cleaning of the bathing area, and makes rooms containing such areas appear more spacious.

In U.S. Pat. No. 4,878,530, there is disclosed in one embodiment a wall mounted bathroom panel assembly where a slidable panel operates in conjunction with a pivotal panel. This assembly provides the desired open access. However, the sliding action between the pivotal and sliding panel is effected by sliding blocks having cylindrical parts which are fixed or arranged to slide in circular recesses of the panels. This sliding arrangement poses problems in that friction develops between the sliding surfaces of the blocks and the recesses and close tolerances must be adhered to for efficient operation. This arrangement also makes the adjustment of the doors relative to one another difficult. Further, a complex frame structure is required with specially designed connection pieces to support the sliding arrangement.

Moreover, U.S. Pat. No. 4,878,530 does not provide an easy means of cleaning under the panels near the pivot area, nor teaches ways in which two of such assemblies can be used together to form a four panel structure. Thus, a need exists for an improved bathing door unit.

SUMMARY OF THE INVENTION

In one form, the invention provides a pivotal and extendable bathing door unit wherein a first panel is adapted to be pivotally connected to a supporting wall with the first panel having a roller track at the upper end thereof. A second panel is adapted to be extendably connected to the first panel and also has a roller track at the upper end thereof. There is a first roller connected to the first panel that is constructed and arranged to ride in the roller track of the second panel. A guide is connected to the second panel which is constructed and arrangable to ride in the roller track of the first panel.

In a preferred form, the guide connected to the second panel is a roller and both panels also have rollers and roller tracks at their lower ends with the lower roller of the first panel being suitable to ride in the lower track of the second panel and the lower roller of the second panel being suitable to ride in the lower track of the first panel.

In another embodiment, there are camming means operatively associated with a lower end of a lateral support for pivotal connection of the first panel to provide a lifting action to the first panel upon rotation thereof.

In yet another embodiment, there are magnetic means operatively connected to a lateral edge of the second panel opposite the first for magnetic attraction to a vertically extending magnetic strip.

In still another embodiment, a three sided, discontinuous frame structure is provided for the panel members of the panels.

In yet another embodiment one of rollers is linked to an adjustment means for vertically positioning the rollers relative to the tracks.

It is, therefore, a principal object of the invention to provide a pivotal and an extendable bathing door unit of the above type which can provide a low friction operation without requiring close tolerances.

It is yet another object of the invention to provide a bathing door unit of the foregoing type which can be produced at low cost.

It is still another object of the invention to provide an extendable bathing door unit of the foregoing type wherein the roller means for providing the extendibility of the panels can be easily adjusted.

It is another object of the invention to provide an extendable bathing door unit of the foregoing type which is adaptable to various sizes of bathing facilities.

It is still a further object of the invention to provide an extendable bathing door of the foregoing type which affords a lifting thereof to facilitate cleaning purposes, and provides a stable open and closed door position.

It is yet a further object of the invention to provide an extendable bathing door of the foregoing type which can be employed as single or multiple units.

The foregoing and other objects and advantages of the invention will appear in the following detailed description. In the description, reference is made to the accompanying drawings which show, by way of illustration and not limitation, preferred embodiments of the invention.

DESCRIPTION OF THE DRAWINGS

FIG. 8 an enlarged view, in partial horizontal section illustrating rating a bistable positionary mechanism for doors;

FIG. 9 a view in vertical section illustrating the mechanism of FIG. 8 in a first position;

FIG. 10 is a view similar to FIG. 9 illustrating the mechanism in second position;

DESCRIPTION OF THE PREFERRED EMBODIMENTS

Figure 1:
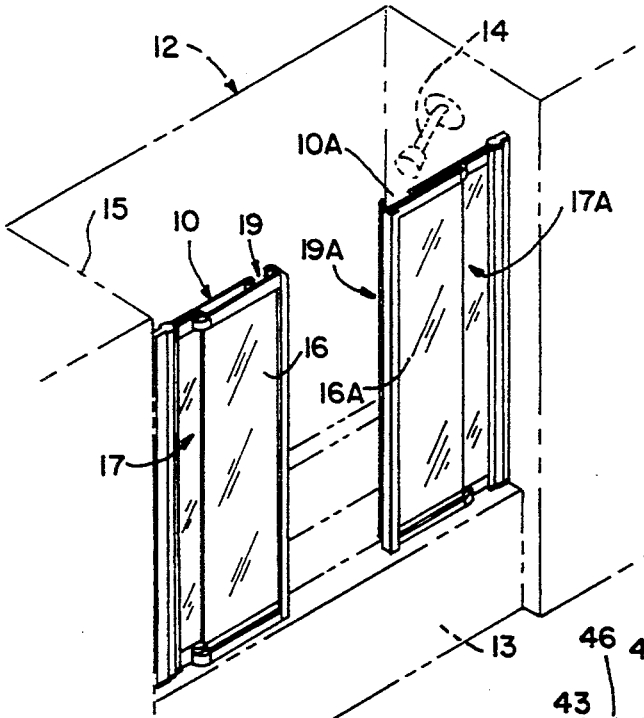
FIG. 1 a top perspective view showing two of the bathing door units of this invention in conjunction with a bathing facility.
Figure 3:
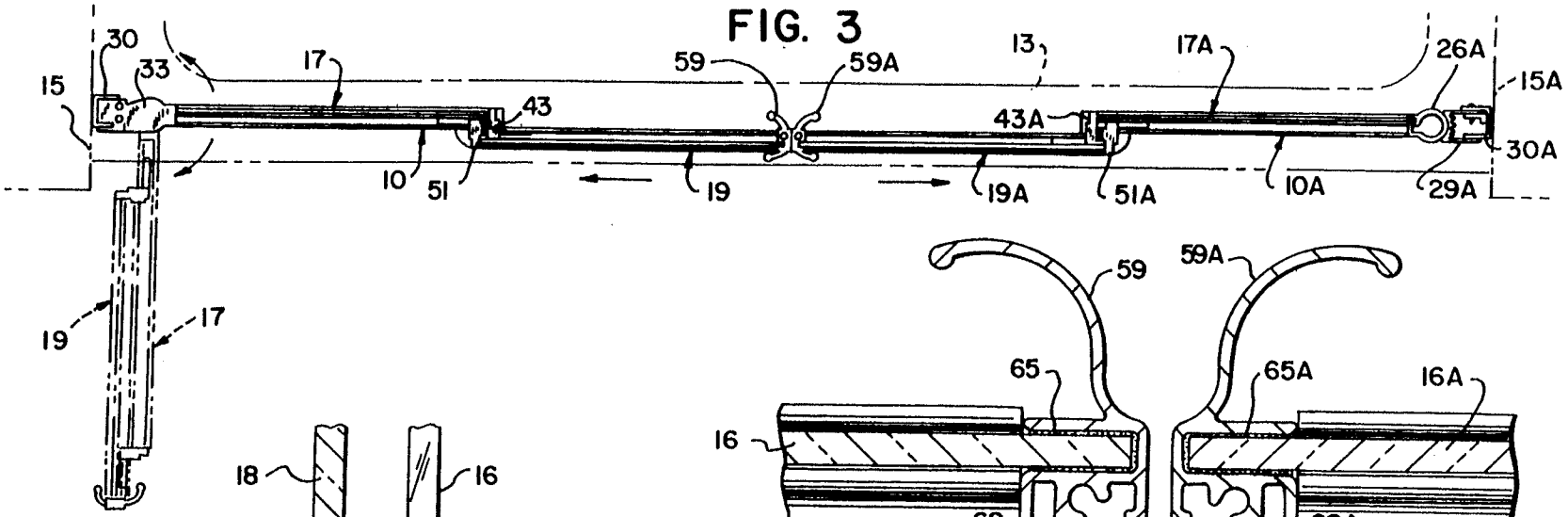
FIG. 3 is a top plan view illustrating the two folding bathing door units positioned as to fully extend the doors to a "closed" position.

Referring to FIGS. 1 and 3, the bathing door units of this invention are shown generally at 10 and 10A in conjunction with the bathing facility 12 having a tub 13 and a shower head 14. Each of the units 10 and 10A have the same components with those of unit 10A designed by the same reference numeral followed by the letter "A". The difference is in the orientation of the panels generally 17, 19 and 17A and 19A. This is seen in conjunction with FIG. 3 where the bathing units 10 and **10*a* are shown in an extended or closed position with respect to the bathing facility 12**.

Figure 2:
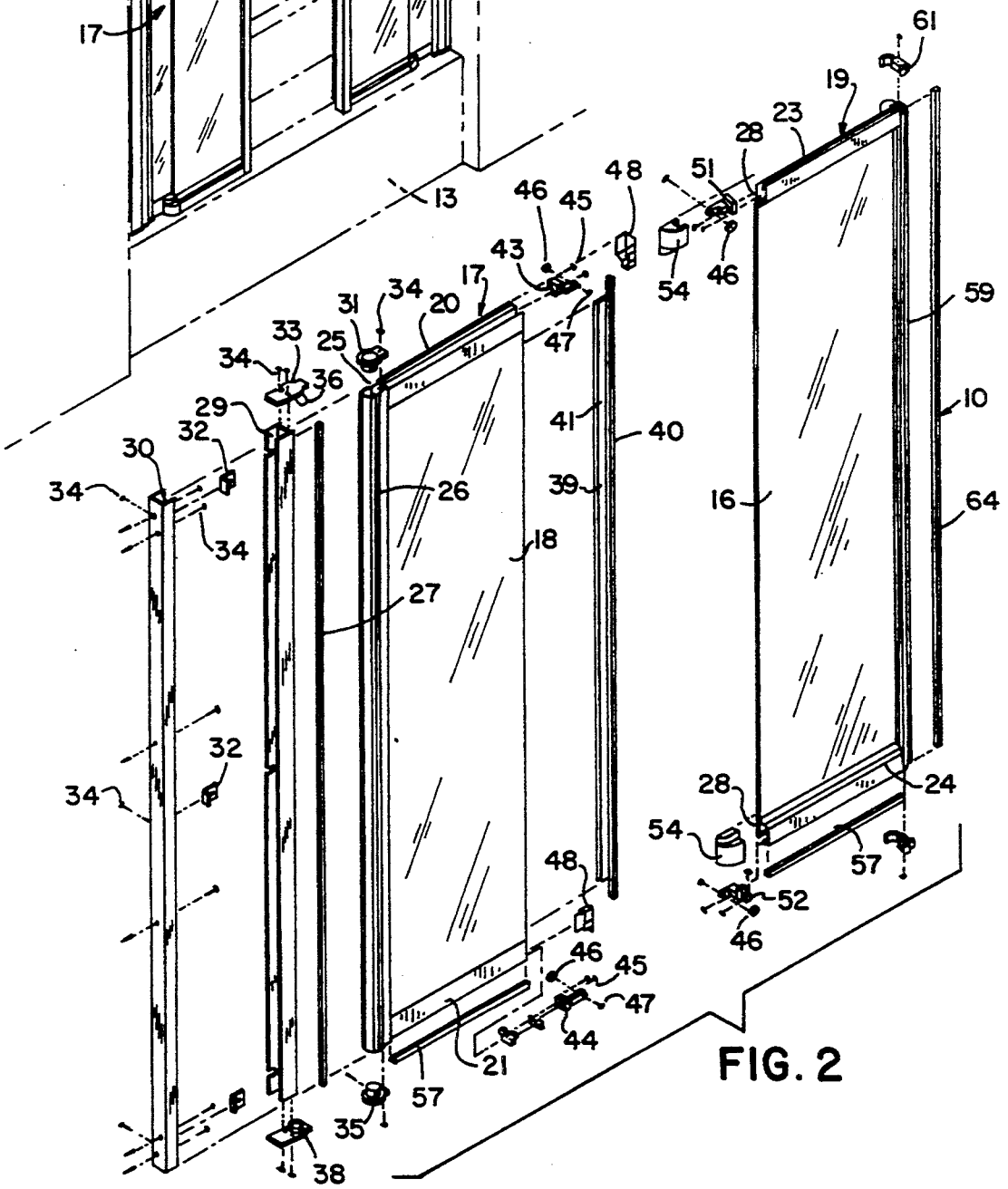
FIG. 2 is an exploded perspective view of one of the bathing door units shown in FIG. 1.

Referring specifically to FIG. 2, it is seen that each of the bathing door units as represented by unit generally 10, is composed of two panel members 16 and 18 with panel member 16 being a slidable panel and 18 being a pivotable panel member such as will be better understood as the description proceeds. Panel generally 17 includes panel member 18 as well as a top frame 20 and a bottom frame 21. In a similar manner, panel generally 19 also has similar top and bottom frames 23 and 24 secured to the top and bottom of panel member 16. All of the frames 20, 21, 23 and 24 have roller tracks such as 28.

Positioned along the side of panel member 18 is a pivot column 26 which has a pivot bushing 31 connected thereto at its upper end by the screw 34. Pivot bushing 31 is adapted to be engaged by the projection 36 of the pivot block 33 which is attached to the expander jam 29 also by the screws 34. It should be further noted that attached to the bottom of the expander jam 29 is a pivot block 38 for engagement with pivot bushing 35 which is secured to the bottom of the column 26. This will be more fully explained later in conjunction with FIGS. 8–10. A felt seal 27 is attached to the expander jam 29 for sealing against pivot column 26. Expander jam 29 is in turn attached to a wall jam 30 by the screws 34 and, the adjustment clamps 32. Wall jam 30 is secured to the wall such as 15 (see FIGS. 1 and 3).

As seen in FIG. 2, there are roller brackets 43 and 44 attached to the ends of top and bottom frames 20 and 21, respectively; of panel 17 by means of the screws 45. Rollers 46 are rotatably mounted on the brackets 43 and 44 by means of the arms such as 70 shown in FIG. 5 and ride in tracks 28 of panel 19. In a similar manner, roller brackets 51 and 52 are attached to the ends of top and bottom frames 23 and 24, respectively, of panel 19 by means of screws 45 and ride in tracks of panel 17 as will be seen later in conjunction with the FIG. 5–7 and FIGS. 11 and 12 descriptions. Suitable end caps 48 and 54 are also provided for the respective roller brackets 43, 44, 51 and 52. Attached to the undersides of frames 21 and 24 are seals 57. Secured to one end of the panel member 18, such as by the groove 41 by a friction fit, is a seal member 39 having a side portion 40 for sealably and slidably engaging the adjacent surface of panel member 18 when panel member 16 slides thereover. Secured to the other end of panel member 16 is a handle 59 enclosed at opposite ends by end caps 61 and 62.

Figure 4:
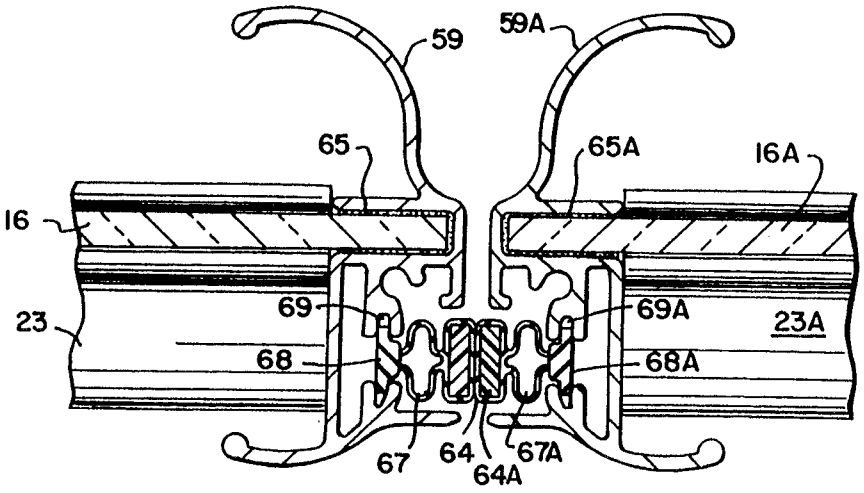
FIG. 4 is an enlarged view in horizontal section illustrating a magnetic lock of the bathing door units in the closed position.

Referring specifically to FIG. 4, the handles 59 and 59A are secured to the ends of panel members 16 and 16A by means of the compartments 65 and 65A and an adhesive. Magnets 64 and 64A are interconnected to the handles 59 and 59A such as by the flexible sections 67 and 67A extending from the connecting portions 68 and 68A secured in slots 69 and 69A. This construction affords a releasable but retentive closure of the bathing door units 10 and 10A as also seen in FIG. 3.

Figure 5:
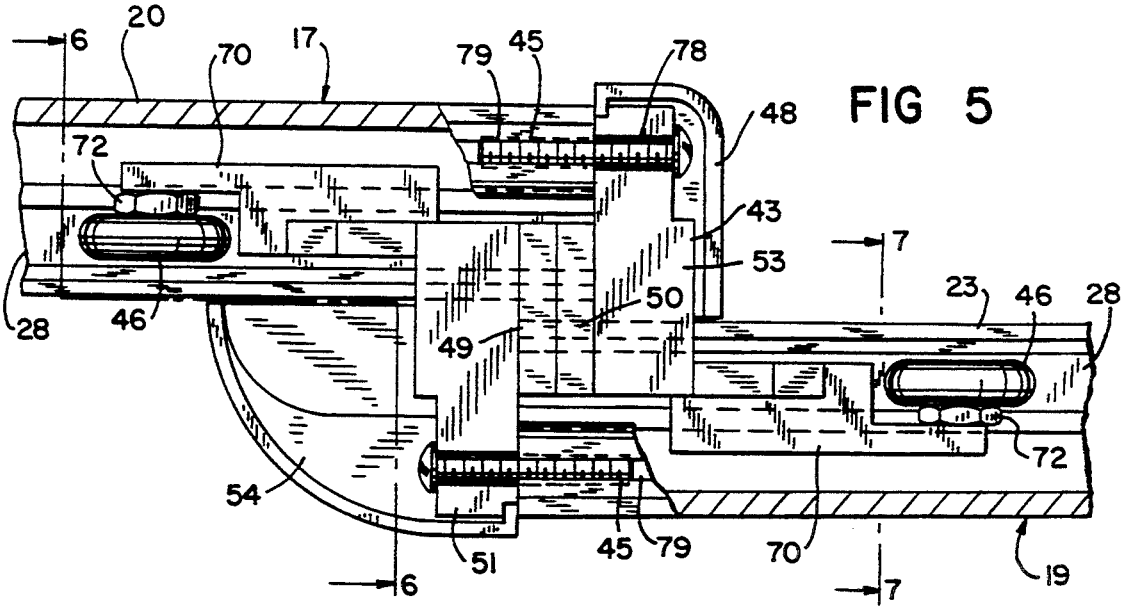
FIG. 5 is an enlarged detail view illustrating the joint between panels.
Figure 6:
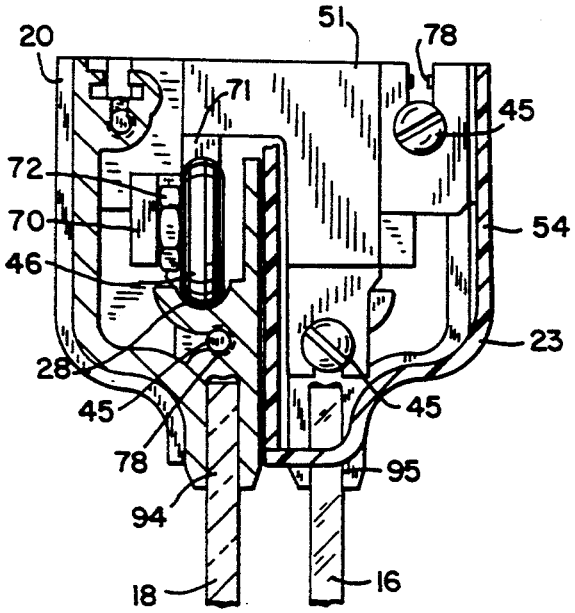
FIG. 6 is sectional view taken along line 6—6 of FIG. 5.
Figure 7:
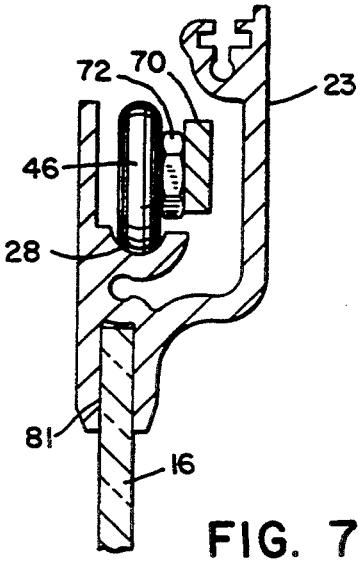
FIG. 7 is a sectional view taken along line 7—7 of FIG. 5; is

FIGS. 5–7 illustrate the positioning of the rollers 46 in the tracks of the panels 17 and 19. Each of the bracket members 43 and 51 have elongated arms 70 to which are attached the rollers 46 by means of the shafts of screws 47 (See FIG. 2) which are held in a nonrotatable manner by lock nuts 72. These elongated arms 70 are interconnected to the bracket members 43 and 51 through a vertical leg portion such as shown at 71 in FIG. 6. The bracket members 43 and 51 are attached to the ends of the respective top frames 20 and 23 by the screws such as 45 passing through the slots 78 and into grooves 79. All of the frame extrusions have slots such as shown at 81 in FIGS. 6 and 7 for receiving the panel members such as 16 and 18. The panel members have been secured therein by a suitable adhesive such as Speed Bonder 324 structural adhesive and solventless activator FMD 387 both available from the Loctite Corporation in Newington, Conn.

Figure 11:
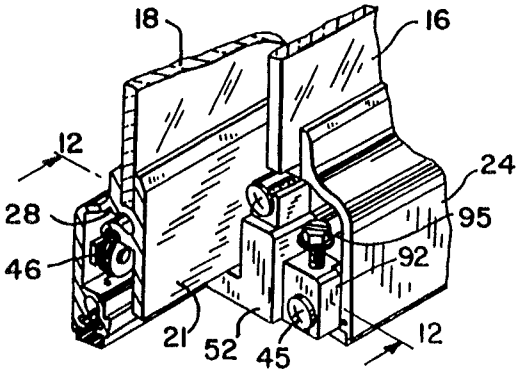
FIG. 11 is an enlarged detail view showing an adjustment feature for the rollers at the bottom of the door.
Figure 12:
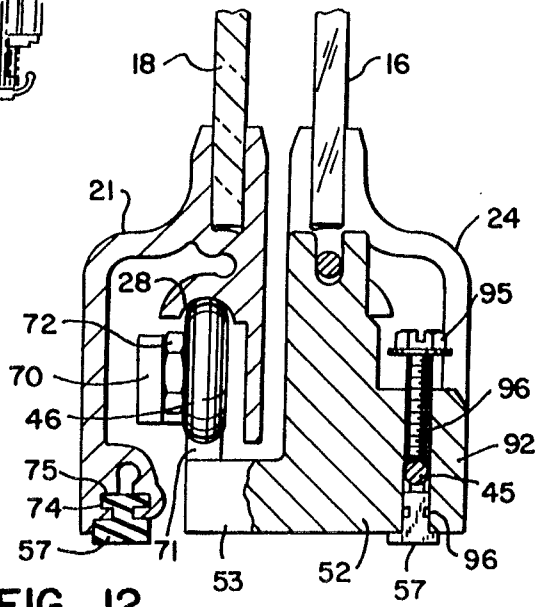
FIG. 12 is a sectional view taken along line 12—12 of FIG. 11.

Referring specifically to FIG. 5, there is illustrated the positioning of the arms 70 and the rollers 46 from their respective brackets 43 and 51. Bracket 51 positions a roller 46 in the roller track 28 of top frame 20 and bracket 43 positions a roller 46 in the roller track 28 of the top frame 23. These oppositely positioned roller brackets 43 and 51 also serve the purpose of providing a stop for the panel 19 as it is slid away from the panel 17. This can also be seen in conjunction with FIG. 3. Suitable resilient bumper members 49 and 50 are connected to brackets 51 and 43 for shock absorbing purposes. It will be appreciated that the same reciprocal positioning of the rollers 46 from the brackets 44 and 52 will prevail at the bottom ends of the panel members 18 and 16 for positioning the rollers in the roller tracks 28 of respective frames 24 and 21, as seen in FIGS. 2, 11 and 12. It should be noted in this regard that the lower brackets 44 and 52 have a reverse arm configuration such as 71 with respect to the top brackets 43 and 51. It extends upwardly as seen in FIG. 12 and the connecting portion 53 is reversed.

Referring to FIGS. 8, 9 and 10, these show the lifting mechanism for the panel member 18 and accordingly panel member 16. A pivot bushing 35 is attached to the pivot column 26 by the screw 91 fastened through the hole 84 and into groove 79. There are opposing holes 81 and 83 in the bushing 35 which accommodate cam pin 82. Cam pin 82 rides over the hill type cam surfaces 87 and 89 of cam member 85 and rides upwardly thereon until the cam pin rests in the opposing groves 89 and 90. When the cam pin 82 rests in the lowest portion of the cam surfaces 87 and 88, the panel members 18 and 16, will be in a lowered position as indicated in FIG. 9. When panel member 18 is pivoted, this will cause the cam pin 82 to ride up the cam surfaces 87 and 88 to ultimately rest in the opposing groves 89 and 90 to effect a raising of the panel member 18 such as indicated in FIG. 10. This raising motion affords a distance between the panel members 18 and 16 and. the upper edge of a bathing facility such as tub 13 to afford easy cleaning. As seen in FIG. 8, there is a slot 93 provided in the pivot block 38 to accommodate a lower portion of a leg of the expander jam 29 and wall jam 30. This affords a stable construction.

FIGS. 11 and 12 illustrate the adjustment feature of lower bracket member 52 and roller 46. This is afforded by an adjustment slot 96 extending through block portion 92 of the bracket 52 with slot 96 accommodating screw 45, which is fastened into frame 24. Adjustment of the height of roller 46 against track 28 in frame 21 is effected by loosening screw 45 and turning adjustment screw 95 in threaded passage 96. When the desired adjustment is made, screw 45 is retightened. As best seen in FIG. 12, a bottom seal 57 is provided having an enlarged head 74 for fitting into undercut 75 of frame member 21 as well as frame member 24.

An important feature in the fabrication of the bathing door unit 10 is the fact that there is no continuous frame structure surrounding the panel members 16 and 18. This affords ease and economy in fabrication. It should be noted that the panel members 16 and 18 are surrounded on three of their sides with frame structures such as top frame 20 and bottom frame 21 and pivot column 26 with respect to panel 18 and top and bottom frames 23 and 24 and handle 59 with respect to frame 16. They are all secured to the respective panels merely by slots in the extrusions such as 25 in pivot column 26 and 94 and 95 in frames 20 and 23 as well as the use of adhesive. Yet with only this somewhat limited structure, a rigid and very efficient sliding system is afforded by means of the brackets such as 43, 44, 51 and 55 attached to the frame members for suitable and slidable support of the rollers.

Yet another important feature is the fact that the upper frames 20 and 23 as well as lower frames 21 and 24 can be interchanged to provide left or right hand panel assemblies 10 and 10A. Upper brackets 43 and 51 can be interchanged as can lower brackets 44 and 52. This results in lower cost.

While preferred embodiments have been described above, it should be readily apparent to those skilled in the art from this disclosure that a number of modifications and changes may be made without departing from the spirit and scope of the invention. For example, in the previous description there was shown a single roller member 46 supported by the bracket arms 70. It can be appreciated that a multiplicity of roller members could be secured thereto. This would provide even a more easily slidable bath door unit. However, it would be more costly. Further, while a magnetic attraction system is shown in FIG. 4 for closing the opposing panels 19 and 19A of units 10 and 10A, the magnetic system could be employed in conjunction with one panel 19 of unit 10 and a magnetic strip such as fastened to a wall. Alternatively, these could be eliminated and still have the advantages of the simplified frame structure and roller system. The same is true with respect to the raising and lowering apparatus shown in FIGS. 8, 9 and 10.

We claim:

1. A pivotal and extendable bathing door unit, comprising:

a first panel adapted to be pivotally connected to a supporting wall, said first panel having a roller track at the upper end thereof;

a second panel adapted to be extendably connected to said first panel, said second panel having a roller track at the upper end thereof;

a bracket member connected to said first panel;

a roller connected to the bracket member and adapted to ride in the roller track of the second panel; and a guide connected to said second panel and adapted to ride in said roller track of said first panel.

2. The door unit of claim 1, wherein the guide is a roller.

3. The door unit of claim 2, wehrein both panels have lower ends with lower rollers and lower roller tracks, with a lower roller of the first panel lower end being adapted to ride in a lower track of the second panel lower end and a lower roller of the second panel lower end being adapted to ride in a lower track of the first panel lower end.

4. The door unit as defined in claim 3, wherein at least one of said rollers is connected to an adjustment means for vertically positioning said roller relative to said tracks.

5. The door unit as defined in claim 1, wherein said first and second panels are secured to discontinuous frame structures.

6. The door unit as defined in claim 5, wherein said frame structure are of a three-sided configuration.

7. The door unit of claim 1 further including magnetic means connected to a lateral edge of said second panel opposite said first panel for magnetic attraction to a vertically extending magnetic strip.

8. The door unit as defined in claim 7, wherein said magnetic means includes a flexible magnetic strip frictionally engaged by a handle portion.

9. The door unit of claim 8, wherein the vertically extending magnetic strip is on a lateral edge of a third laterally extending panel.

10. A pivotal and extendable bathing door unit, comprising:

a first panel pivotally connected to a supporting wall; along a lateral vertically extending side support;

a second panel laterally extendably connected to said first panel to be moveable towards and away from the support; and camming means connected to a lower end of said support to provide a lifting action and an intermediate resting position for said first panel upon rotation thereof.

11. The door unit of claim 10, wherein the camming means includes a raised portion for lifting the door between the two lower portions.

12. The door unit of claim 11, wherein said camming means includes a pin adapted to ride along the raised portion.

* * * * *

UNITED STATES PATENT AND TRADEMARK OFFICE
CERTIFICATE OF CORRECTION

PATENT NO. : 5,417,272

DATED : May 23, 1995

INVENTOR(S) : James L. Marlowe et al.

**It is certified that error appears in the above-identified patent and that said *Letters Patent is hereby* corrected as shown below:**

| | |
|---|---|
| Column 1, line 2 | after "invention" "1." should be deleted. |
| Columb 1, line 2 | "Field of the Invention" should shart a new line. |
| Column 1, line 7 | after "support" "2." should be deleted. |
| Column 1, line 7 | "Description of the Prior Art" should start a new line. |
| Column 2, line 49 | after "Fig. 5;" "is" should be deleted. |
| Column 2, line 50 | after "Fig. 8" --is-- should be inserted. |
| Column 2, line 51 | after "illustrating" "rating" should be deleted. |
| Column 2, line 51 | after "for" --the-- should be inserted. |
| Column 2, line 53 | after "Fig. 9" --is-- should be inserted. |
| Column 2, line 56 | after "in" --a-- should be inserted. |
| Column 3, line 33 | after "and" the "," should be deleted. |
| Column 3, line 37 | after "respectively" the ";" should be --,--. |
| Column 4, line 53 | after "16 and" the "." should be deleted. |

UNITED STATES PATENT AND TRADEMARK OFFICE

CERTIFICATE OF CORRECTION

PATENT NO. : 5,417,272

DATED : May 21, 1995

INVENTOR(S) : James L. Marlows, et al

It is certified that error appears in the above-indentified patent and that said Letters Patent is hereby corrected as shown below:

Column 6, line 27, after "frame" "structure" should be --structures--.

Signed and Sealed this

Twenty-third Day of July, 1996

*Attest:*

Bruce Lehman

BRUCE LEHMAN

*Attesting Officer*

*Commissioner of Patents and Trademarks*